US006485612B1

(12) United States Patent
Graf

(10) Patent No.: US 6,485,612 B1
(45) Date of Patent: Nov. 26, 2002

(54) AIR PRESS ASSEMBLY FOR USE IN A PAPER-MAKING MACHINE

(75) Inventor: Edwin X. Graf, Menasha, WI (US)

(73) Assignee: Voith Paper, Inc., Appleton, WI (US)

( * ) Notice: Subject to any disclaimer, the term of this patent is extended or adjusted under 35 U.S.C. 154(b) by 0 days.

(21) Appl. No.: 09/860,873

(22) Filed: May 18, 2001

(51) Int. Cl.[7] ..... D21F 3/02

(52) U.S. Cl. ..... 162/358.1; 34/122; 34/123; 100/153; 162/360.2

(58) Field of Search ..... 162/206, 207, 162/305, 358.1, 360.2, 360.3; 100/153; 34/119, 122, 123, 124

(56) References Cited

U.S. PATENT DOCUMENTS

| | | | | | |
|---|---|---|---|---|---|
| 3,447,247 | A | * | 6/1969 | Daane | 34/122 |
| 3,808,096 | A | | 4/1974 | Busker et al. | 162/358 |
| 4,074,441 | A | * | 2/1978 | Helversen | 34/122 |
| 4,124,942 | A | | 11/1978 | Ohis et al. | 34/115 |
| 4,172,910 | A | | 10/1979 | Rotar | 427/243 |
| 4,173,249 | A | | 11/1979 | Holkko et al. | 162/360 R |
| RE30,268 | E | * | 5/1980 | Justus | 162/358.3 |
| 4,559,106 | A | | 12/1985 | Skytta et al. | 162/358 |
| 4,675,079 | A | | 6/1987 | Webster | 162/360.1 |
| 4,888,096 | A | | 12/1989 | Cowan et al. | 162/35 R |
| 5,256,257 | A | * | 10/1993 | Schiel | 162/358.3 |
| 5,274,930 | A | | 1/1994 | Ensign et al. | 34/23 |
| 5,584,126 | A | | 12/1996 | Ensign et al. | 34/444 |
| 5,625,961 | A | | 5/1997 | Ensign et al. | 34/117 |
| 5,700,356 | A | | 12/1997 | Lefkowitz | 162/358.1 |
| 6,161,303 | A | * | 12/2000 | Beck | 34/119 |

FOREIGN PATENT DOCUMENTS

| | | | |
|---|---|---|---|
| CS | 85537 | 12/1974 | D21F/9/00 |
| GB | 1599347 | 9/1981 | D21F/3/04 |
| PL | 141 560 | 10/1986 | D21F/9/02 |
| WO | WO 99/23296 | 5/1999 | D21F/1/48 |
| WO | WO 99/23301 | 5/1999 | D21F/11/14 |

OTHER PUBLICATIONS

Joseph R. Pounder, Elementary Mathematical Models of Displacement Pressing, TAPPI Journal, Feb., 1987, pp 97–100.

Wlodzimierz Kawka and Edward Szwarcsztajn, Some Results of Investigations on the Equipment for Intensive Dewatering and Drying of Porous Papers, Technical University of Lodz/Poland, Paper No. 31, pp 153–169.

Thomas Pfuff and Werner Stahl, Dewatering by Mechanical Compression Followed by Application of Differential Gas Pressure, Chemie–Ingenieur–Technik 64, No. 3, 1992, pp 298–299.

Jeffrey D. Lindsay, Displacement Dewatering to Maintain Bulk, Helsinki Symposium on Alternate Methods of Pulp and Paper Drying, Helsinki, 1991.

* cited by examiner

*Primary Examiner*—Karen M. Hastings
(74) *Attorney, Agent, or Firm*—Taylor & Aust, P.C.

(57) ABSTRACT

A press assembly for use in a paper-making machine includes a roll, a first air press backing assembly and a second air press backing assembly. The first air press backing assembly and the second air press backing assembly each include an inner wall, an outer support structure and a plurality of inflatable hoses interposed between the inner wall and the outer support structure. The inner wall is positioned adjacent to and defines an air chamber with the roll.

18 Claims, 1 Drawing Sheet

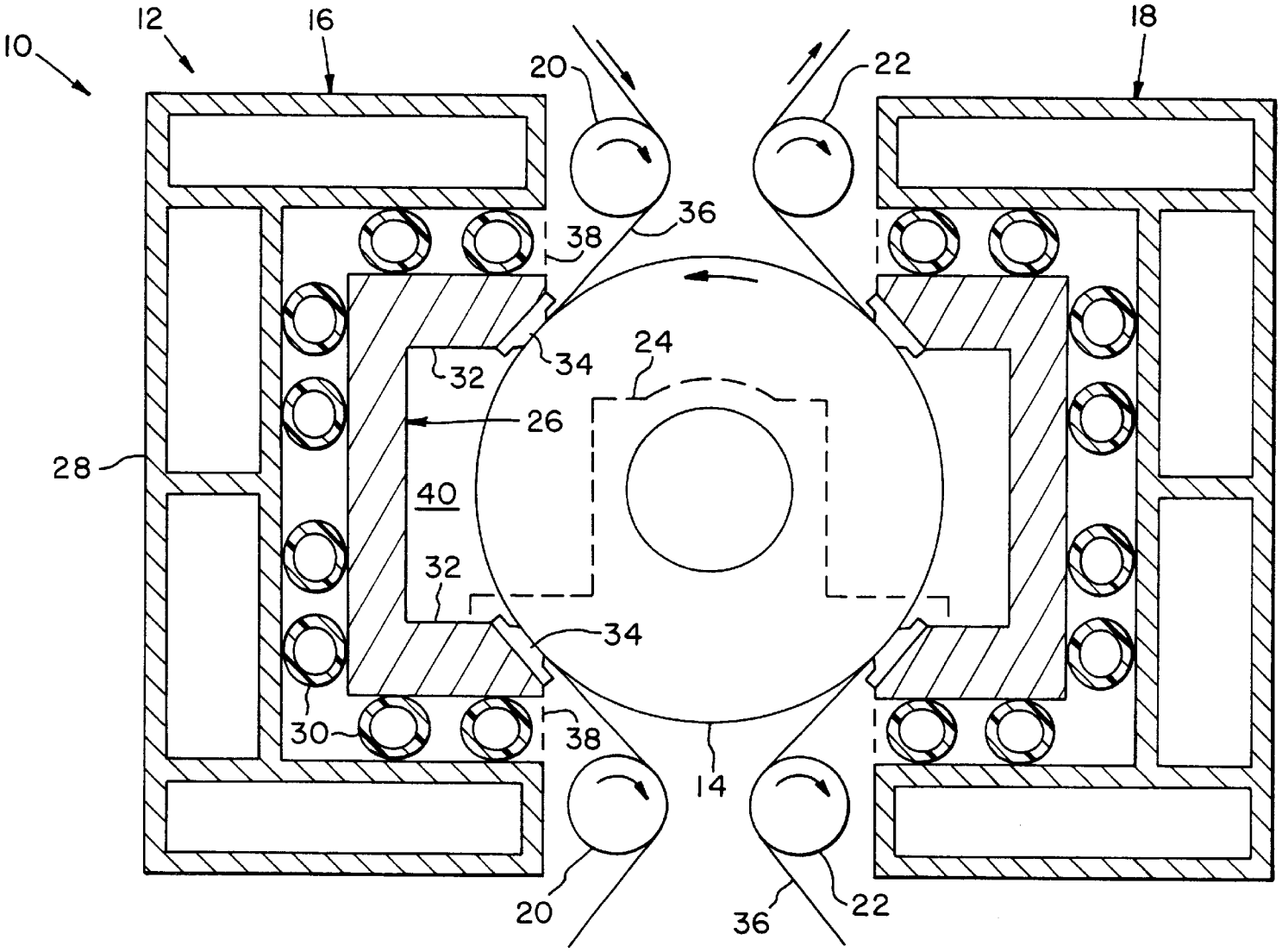
10
12
16
18
20
22
24
26
28
30
32
34
36
38
40
14

AIR PRESS ASSEMBLY FOR USE IN A PAPER-MAKING MACHINE

BACKGROUND OF THE INVENTION

1. Field of the Invention

The present invention relates to paper-making machines, and, more particularly, to air presses within a paper-making machine.

2. Description of the Related Art

A paper-making machine receives a prepared fiber suspension and manufactures a fiber web therefrom. A paper-making machine may in general include a head box, forming section, press section and drying section. The press section typically includes a plurality of press assemblies which apply pressure to the web for the primary purpose of expressing water therefrom. Press assemblies are typically configured as mechanical press assemblies, such as extended shoe nip presses, etc. It is also known to configure a press assembly as an air press including an air chamber which exerts pressure against the fiber web for the purpose of expressing moisture therefrom. Examples of air presses which may be utilized on a papermaking machine are disclosed in U.S. patent application Ser. No. 09/409,287, entitled "Pressing Apparatus Having Semi-Permeable Membrane" now U.S. Pat. No. 6,416,631, and 09/408,691, entitled "Pressing Apparatus Having Chamber and Sealing", now U.S. Pat. No. 6,161,303, each of which are assigned to the assignee of the present invention.

Although air press assemblies as described above provide effective pressing of a fiber web, a need still exists to provide a higher capacity air press while at the same time occupying less physical space.

SUMMARY OF THE INVENTION

The present invention provides an air press assembly for a paper-making machine, including a single roll which defines two separate air presses.

The invention comprises, in one form thereof, a press assembly for use in a paper-making machine including a roll, a first air press backing assembly and a second air press backing assembly. The first air press backing assembly and the second air press backing assembly each include an inner wall, an outer support structure and a plurality of inflatable hoses interposed between the inner wall and the outer support structure. The inner wall is positioned adjacent to and defines an air chamber with the roll.

An advantage of the present invention is that two separate air presses are provided using a single roll.

Another advantage is that the structure of each air press assembly is simple and easy to manufacture.

Yet another advantage is that the deflection of the inner wall adjacent the roll may be relatively easily controlled using pneumatic hoses between the inner wall and the outer support structure.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is an end, sectional view of an embodiment of a press assembly of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawings, there is shown an embodiment of a paper-making machine 10 which includes a press assembly 12. Press assembly 12 generally includes a roll 14, a first air press backing assembly 16, a second air press backing assembly 18 and two pairs of guide rolls 20, 22.

Roll 14 is a press roll carried by a pair of bearing assemblies at opposite longitudinal ends thereof, one of which is shown in phantom lines and referenced 24 in the drawing.

First air press backing assembly 16 and second air press backing assembly 18 are each positioned in association with and generally on opposite sides of roll 14. First air press backing assembly 16 and second air press backing assembly 18 are configured identical to each other in the embodiment shown. Thus, for simplicity sake, only first air press backing assembly 16 will be described in detail hereinafter, it being understood that second air press backing assembly 18 is identically configured.

First air press backing assembly 16 includes an inner wall 26, an outer support structure 28 and a plurality of inflatable fluid hoses 30 interposed between inner wall 26 and outer support structure 28. Inner wall 26 has a generally U-shaped cross-sectional configuration with a pair of legs 32 extending towards roll 14. Each leg 32 carries a corresponding seal 34 which is positioned adjacent to a felt 36 carried by roll 14. A fiber web, such as a paper web, is in turn carried by felt 36 between felt 36 and roll 14. Guide rolls 20 associated with first air press backing assembly 16 guide felt 36 and the paper web carried thereby into the nips between seals 34 and roll 14. Inner wall 26 may be separate from outer support structure 28 as shown, or may be integrally coupled therewith as indicated by dashed lines 38.

Guide rolls 20 associated with first air press backing assembly 16 and guide rolls 22 associated with second air press backing assembly 18 each rotate in a common direction, as indicated by the clockwise directional arrows shown with respect to each guide roll 20, 22.

Inner wall 26 of first air press backing assembly 16 is positioned adjacent to and defines an air chamber 40 with roll 14. Air chamber 40 is pressurized using a feed back control system to exert a desired pressing force against the fiber web carried by felt 36.

Inflatable fluid hoses 30 are interposed between inner wall 26 and outer support structure 28, and used to move or deflect inner wall 26 toward roll 14 for ensuring dimensional stability of air chamber 40 defined by inner wall 26. Additionally, fluid hoses 30 can to some extent affect the amount of loading which is applied to felt 36 by seals 34. Fluid hoses 30 are individually controlled using a feedback control system (not shown) to effect local adjustment of inner wall 26. In the embodiment shown, the plurality of fluid hoses 30 are in the form of pneumatic hoses which may be independently controlled during operation.

Outer support structure 28 has a generally U-shaped cross sectional configuration, and includes an intermediate wall 42, an outer wall 44 and a plurality of reinforcing members 46 extending between intermediate wall 42 and outer wall 44. Intermediate wall 42 is positioned adjacent to fluid hoses 30, and thereby provides a backing surface against which fluid hoses 30 act. In the embodiment shown, the plurality of reinforcing members 46 are in the form of reinforcing ribs extending between intermediate wall 42 and outer wall 44. The exact configuration and number of reinforcing members 46 which are required to prevent excessive deformation of outer support structure 28 may vary, depending on the particular application.

During use, roll 14 rotates in a counter clockwise direction as indicated, and each of felts 36 carries a fiber web into the extended nip defined between each inner wall 26 and roll 14. The term "felt", as used herein, is intended generically, and may also include a belt positioned adjacent inner wall 26. The pressure within air chamber 40 is regulated to apply a desired pressure against the fiber web for expressing moisture from the fiber web into the felt. Air hoses 30 are selectively and independently inflated or deflated to ensure dimensional stability of inner wall 26.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press assembly for use in a paper-making machine, comprising:

a roll;

a first air press backing assembly including an inner wall, an outer support structure and a plurality of inflatable fluid hoses interposed between said inner wall and said outer support structure, said inner wall positioned adjacent to and defining an air chamber with said roll; and a second air press backing assembly including an inner wall, an outer support structure and a plurality of inflatable fluid hoses interposed between said inner wall and said outer support structure, said inner wall positioned adjacent to and defining an air chamber with said roll;

wherein each air chamber is structured to be regulated to apply pressure against a fiber web for expressing moisture from the fiber web.

2. The press assembly of claim 1, each of said first air press backing assembly and said second air press backing assembly having a generally U-shaped cross-sectional configuration.

3. The press assembly of claim 2, each of said inner wall and said outer support structure having a generally U-shaped cross-sectional configuration.

4. The press assembly of claim 3, further including a pair of felts carried by said roll, each said felt associated with a respective one of said first air press backing assembly and said second air press backing assembly, each said inner wall including a pair of legs and a pair of seals, each said seal carried by a respective said leg and positioned adjacent a corresponding said felt.

5. The press assembly of claim 3, said outer support structure including an intermediate wall, an outer wall and a plurality of reinforcing members extending between said intermediate wall and said outer wall, said intermediate wall positioned adjacent said fluid hoses.

6. The press assembly of claim 5, said reinforcing members comprising reinforcing ribs.

7. The press assembly of claim 1, said plurality of fluid hoses comprising a plurality of pneumatic hoses.

8. The press assembly of claim 1, further including two pairs of guide rolls, each said pair of guide rolls associated with a corresponding one of said first air press backing assembly and said second air press backing assembly.

9. The press assembly of claim 8, each of said guide rolls rotating in a common direction.

10. A paper-making machine, comprising:

a roll;

a first air press backing assembly including an inner wall, an outer support structure and a plurality of inflatable fluid hoses interposed between said inner wall and said outer support structure, said inner wall positioned adjacent to and defining an air chamber with said roll;

a second air press backing assembly including an inner wall, an outer support structure and a plurality of inflatable fluid hoses interposed between said inner wall and said outer support structure, said inner wall positioned adjacent to and defining an air chamber with said roll;

wherein each air chamber is structured to be regulated to apply pressure against a fiber web for expressing moisture from the fiber web; and a pair of felts carried by said roll, each said felt associated with a respective one of said first air press backing assembly and said second air press backing assembly.

11. The paper-making maching of claim 10, each of said first air press backing assembly and said second air press backing assembly having a generally U-shaped cross-sectional configuration.

12. The paper-making machine of claim 11, each of said inner wall and said outer support structure having a generally U-shaped cross-sectional configuration.

13. The paper-making machine of claim 12, each said inner wall including a pair of legs and a pair of seals, each said seal carried by a respective said leg and positioned adjacent a corresponding said felt.

14. The paper-making machine of claim 12, said outer support structure including an intermediate wall, an outer wall and a plurality of reinforcing members extending between said intermediate wall and said outer wall, said intermediate wall positioned adjacent said fluid hoses.

15. The paper-making machine of claim 14, said reinforcing members comprising reinforcing ribs.

16. The paper-making machine of claim 10, said plurality of fluid hoses comprising a plurality of pneumatic hoses.

17. The paper-making machine of claim 10, further including two pairs of guide rolls, each said pair of guide rolls associated with a corresponding one of said first air press backing assembly and said second air press backing assembly.

18. The paper-making machine of claim 17, each of said guide rolls rotating in a common direction.

* * * * *

UNITED STATES PATENT AND TRADEMARK OFFICE

CERTIFICATE OF CORRECTION

PATENT NO. : 6,485,612 B1
DATED : November 26, 2002
INVENTOR(S) : Edwin X. Graf

It is certified that error appears in the above-identified patent and that said Letters Patent is hereby corrected as shown below:

Title page,
Item [56], References Cited, OTHER PUBLICATIONS, please add -- TAPPI, Characterization of wet felts, TIP 0404– 20, 1976, PP 1-3 --

Signed and Sealed this

Twenty-seventh Day of July, 2004

JON W. DUDAS
*Acting Director of the United States Patent and Trademark Office*